US005121698A

United States Patent [19]

Kelley

[11] Patent Number: 5,121,698

[45] **Date of Patent: * Jun. 16, 1992**

[54] DESK WITH CONCEALED WIRE STORAGE

[75] Inventor: James O. Kelley, Spring Lake, Mich.

[73] Assignee: Sligh Furniture Co., Holland, Mich.

[ * ] Notice: The portion of the term of this patent subsequent to Aug. 14, 2007 has been disclaimed.

[21] Appl. No.: 509,516

[22] Filed: Apr. 13, 1990

Related U.S. Application Data

[63] Continuation-in-part of Ser. No. 320,701, Mar. 8, 1989, Pat. No. 4,948,205.

[51] Int. Cl.[5] ..... A47B 11/00

[52] U.S. Cl. ..... 108/143; 108/50; 312/196; 312/223

[58] Field of Search ..... 108/143, 50; 312/208, 312/196, 223

[56] References Cited

U.S. PATENT DOCUMENTS 1,512,937 10/1924 Knaster ..... 312/196 X
2,850,341 9/1958 Spinner ..... 108/50 X
4,372,629 2/1983 Propst et al. ..... 312/196 X
4,561,619 12/1985 Robillard et al. ..... 108/143
4,681,043 7/1987 Sticht ..... 312/196 X

*Primary Examiner*—Peter A. Aschenbrenner
*Attorney, Agent, or Firm*—Waters & Morse

[57] ABSTRACT

A desk and spaced panels at the edge of the desk forming a half-wall are combined to make the space within the wall available for the storage of wires and equipment associated with devices in use on or adjacent the desk. The half-wall extends above the desk top, and has a slot traversed by the wires leading out to the devices. Brackets that also traverse the slot can be used to support the devices well above the desk surface. The inner panels forming the half-wall are adapted to support shelves under the desk. The brackets also can be mounted in a desk wherein the spaced panels at the surface of the desk, with the slot being formed in a horizontal surface in the desk. The brackets have adjustable support feet and can have cylindrical accessory supports.

29 Claims, 13 Drawing Sheets

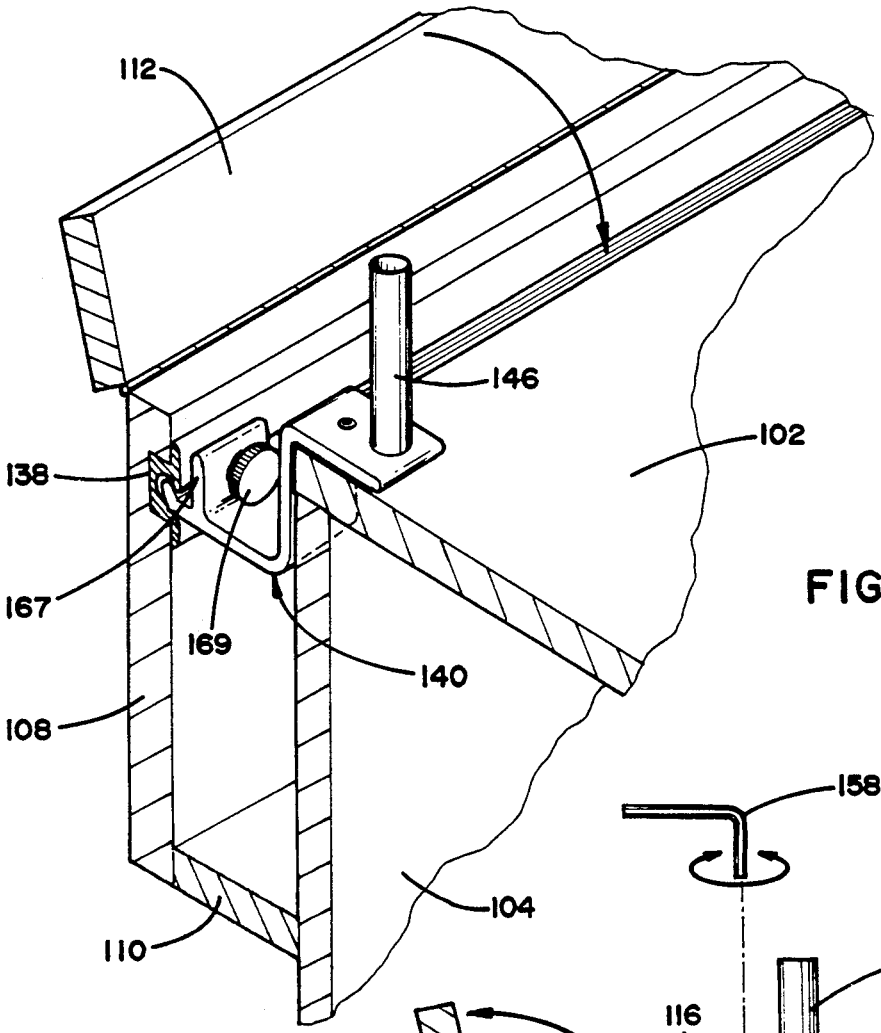
FIG. 16
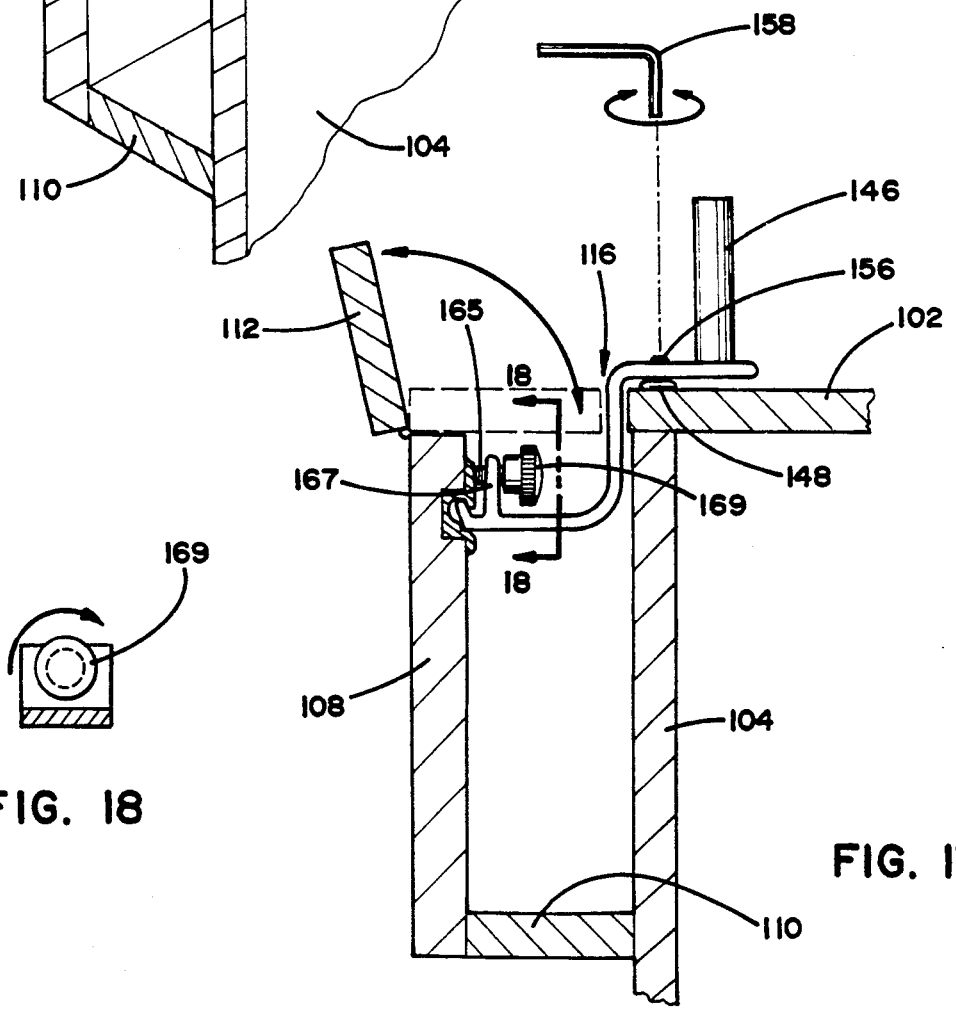
FIG. 17
FIG. 18

DESK WITH CONCEALED WIRE STORAGE

CROSS REFERENCE TO RELATED APPLICATION

This is a continuation-in-part of applicant's co-pending patent application, Ser. No. 320,701, filed Mar. 8, 1989, now U.S. Pat. No. 4,948,205.

BACKGROUND OF THE INVENTION

The increasing amount of electronic and mechanical equipment used in the office work area presents a problem to the designer of high-quality executive and secretarial furniture employing traditional designs, particularly wood furniture. The maintenance of a clean, classical appearance is a requirement, but is made difficult by the need to accommodate the endless mass of wires, conduits, and other support systems for the communication and computer devices the executive or his secretary must have available at all times. One approach to this problem has been to provide a covered trough in the top of a desk to receive this clutter of items. U.S. Pat. No. 3,883,202 discloses desk and storage units mounted on a metal rail. The storage containers are mounted on a rear side of the rail, and desk work surfaces are mounted at different heights on the front of the rail. When a lower height work surface is employed, the rail protrudes above the height of the work surface along the rear edge of the desk surface. The rail provides a wire storage receptacle with a front-facing slot to admit wires leading to devices in use on the desk. Devices of this nature normally take up desk space, are not compatible with traditional designs, and interfere with the movement and organization of the papers and reference material confronting the executive or his secretary. The present invention has been developed to provide a solution to these problems in a structure that can preserve the appearance of clean, classical design.

SUMMARY OF THE INVENTION

A desk incorporates a downwardly extending wire receptacle and conduit running between spaced panels at the rear edges of the desk. In one aspect of the invention, the desk is combined with an integral half-wall structure extending above the level of the desk top and providing space within the wall as the storage receptacle for wires and equipment used on or adjacent the desk. A slot in the wall structure above the desk top is traversed by the wires at selected and movable positions. The top of the wall structure is hinged for the installation access, and defines the top of the slot when the cover is closed. The inner panels forming the wall structure are adapted to support shelves under the desk.

In another aspect of the invention, the spaced panels at the edge of the desk terminate at the surface of the desk. The hinged top is flush with the desk top and the slot is in the horizontal surface of the desk.

In either case, releasable accessory brackets traverse the slots to support devices above the desk, leaving work clearance below them while placing the devices in the best position for use. The accessory brackets connect to a coupling terminal within the half-wall structure that extends parallel to the slot on one of the panels to provide lateral adjustability. An adjustable support foot for each bracket provides vertical position adjustment of the bracket arm. An adjustable support foot on the outer portion of the bracket supports the end of the bracket arm on the desk surface and can be adjusted to vary the level of the bracket arm above the desk. A tubular support on the end of the bracket engages and supports a number of different accessories.

These and other features of the present invention are described in detail below in connection with preferred embodiments of the present invention.

DESCRIPTION OF THE DRAWINGS

FIG. 16 is a fragmentary perspective view of the storage tunnel of the FIG. 12 embodiment, showing the bracket mounted on the accessory rail.

FIG. 17 is a side elevational sectional view of the embodiment of FIG. 12, showing the manner in which the support feet are adjusted to modify the position of the bracket arm.

FIG. 18 is a view taken along line 18—18 of FIG. 17.

DESCRIPTION OF THE PREFERRED EMBODIMENTS

Figure 1:
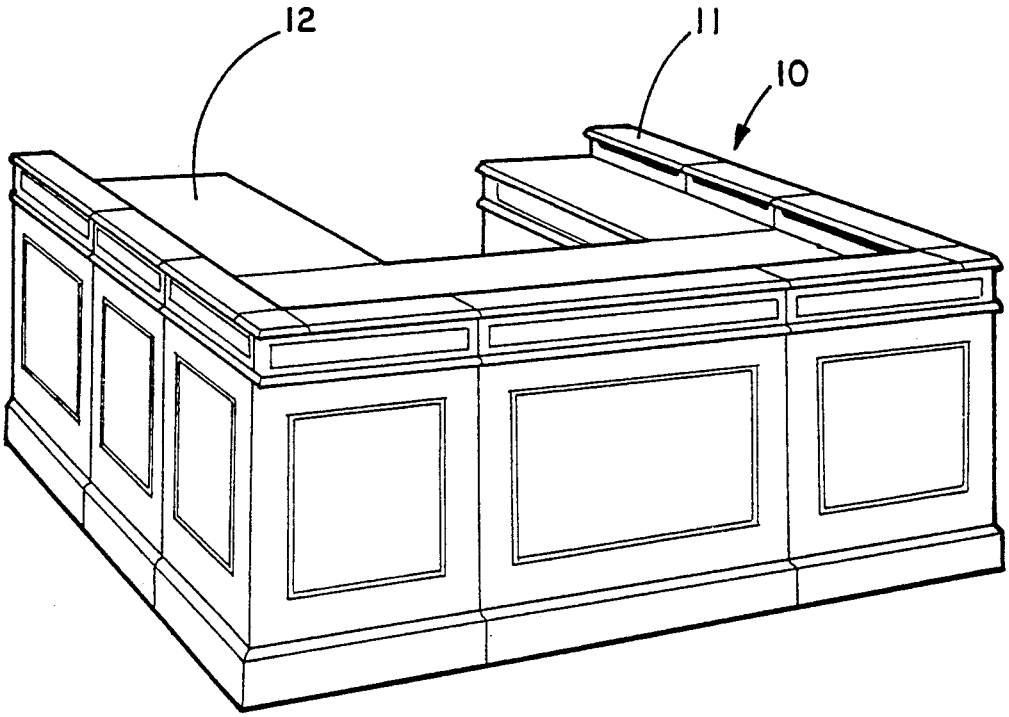
FIG. 1 is a perspective view of a desk in a U-shaped configuration, with the half-wall structure extending above the desk surface around three sides.
Figure 3:
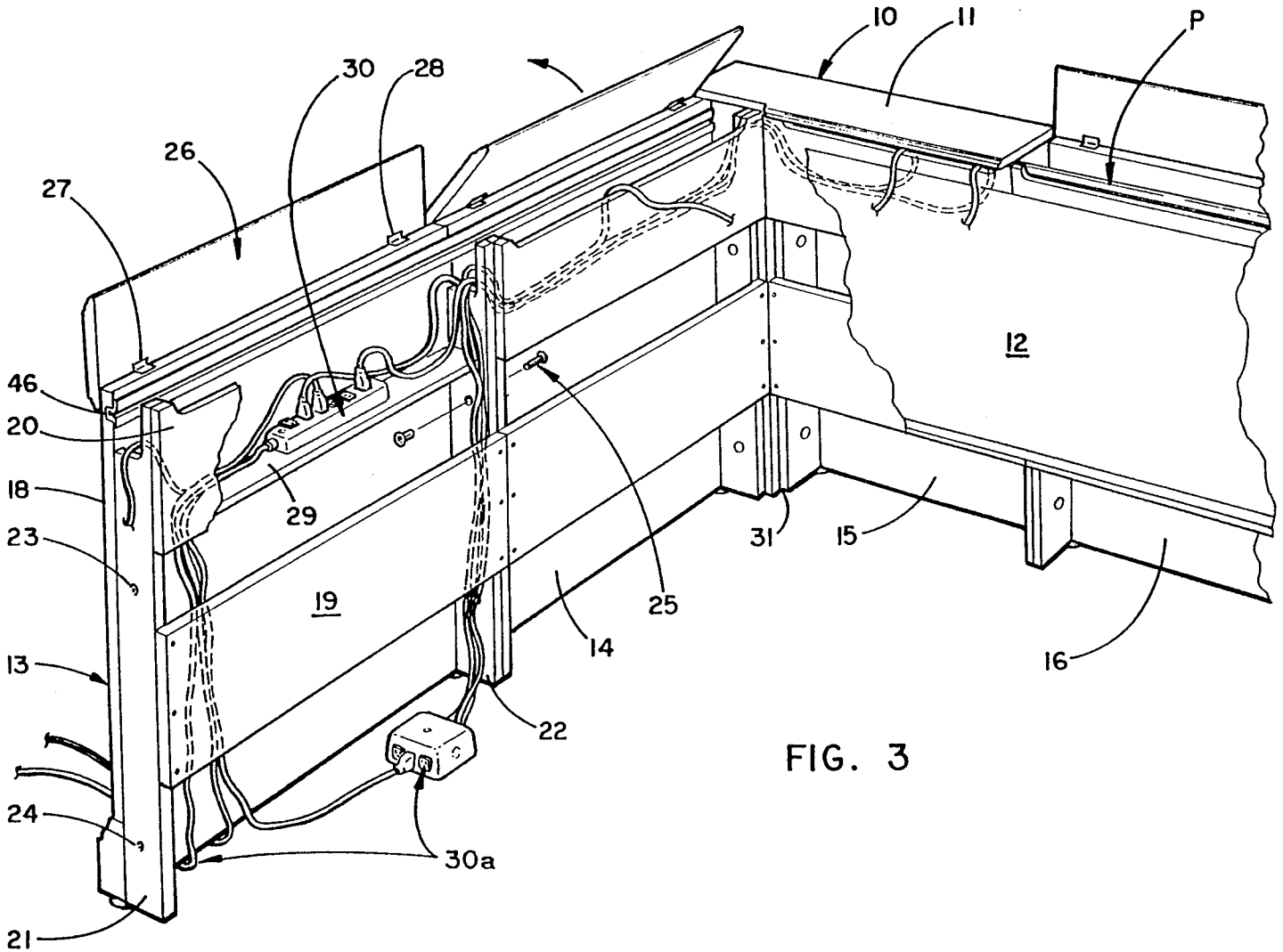
FIG. 3 is a fragmentary perspective view of a group of four half-wall modules connected together around part of the periphery of a desk surface.

Referring to FIG. 1, a wood desk of the traditional design generally indicated at 10 has a half-wall structure 11 extending above the work surface 12 around all three sides of the desk. The structure providing the features of this desk are best shown in FIG. 3. The half-wall modules 13–16 are shown apart from the remainder of the desk structure, with the exception of the panel forming the top surface 12. The modules are similar in construction, and the details described in connection with one of them are essentially the same for the rest. The outer panels 18 are separated from the inner panels 19 and 20 by vertical spacer beams 21 and 22. The abutting spacer beams of adjacent modules are provided with aligned holes as shown at 23 and 24 to receive interengageable fasteners as shown at 25. The cover 26 is hinged to the outer panel 18 as shown at 27 and 28 to provide access to the space between the panels. The floor 29 defines the bottom of the space forming a receptacle for the equipment generally indicated at 30 associated with the various devices arranged on or near the desk top 12. At the right angle junctions of sections of the half-wall structure, it is preferable to include a hollow corner post 31 to receive the module fastenings, and the covers 26 may be interrelated as shown in FIG. 3 at this junction.

Figures 4, 5:
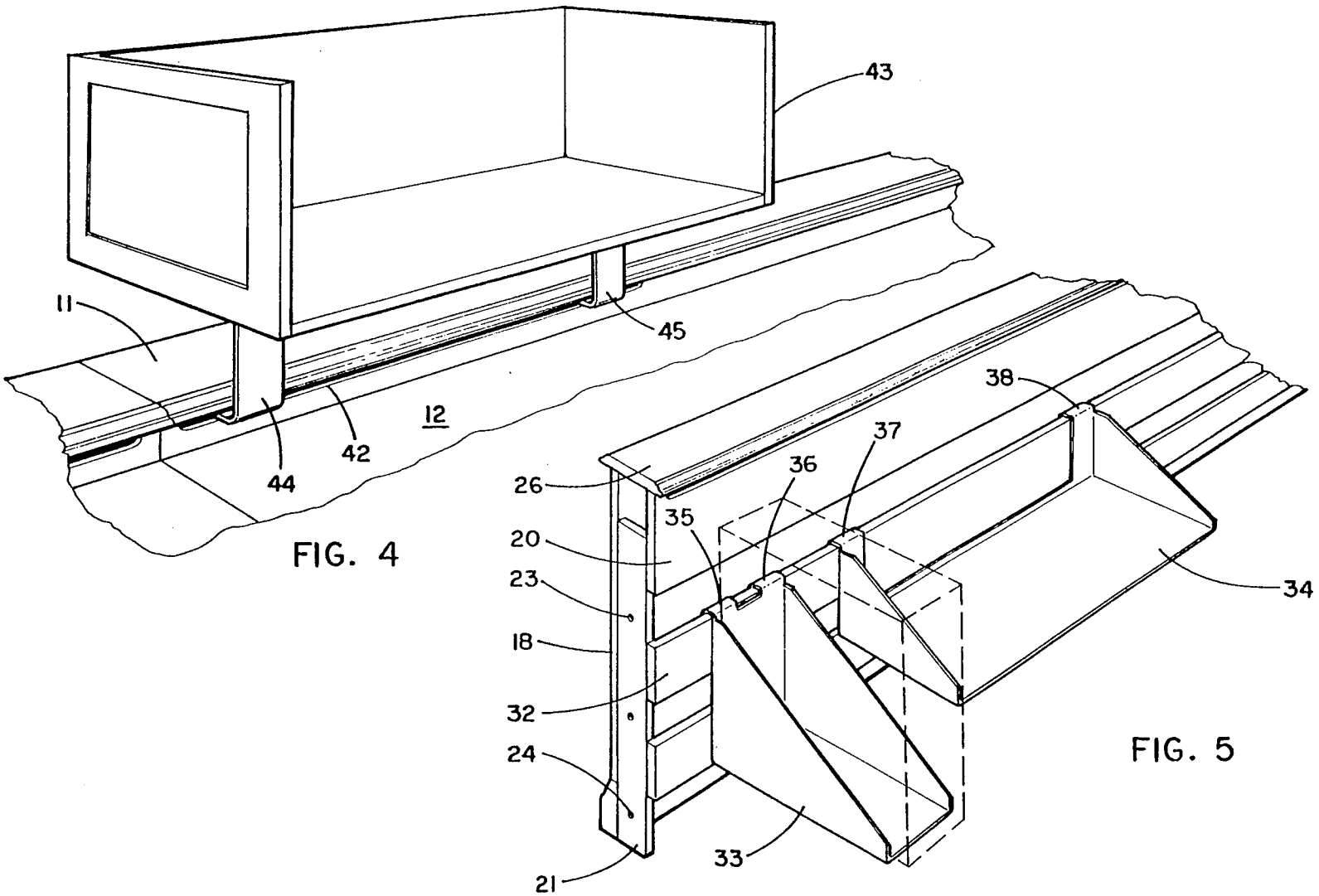
FIG. 4 is a fragmentary perspective view showing a book shelf as an accessory installed on a desk embodying this invention.
FIG. 5 is a fragmentary perspective view showing the installation of shelves underneath the desk surface, supported by the half-wall structure.

Referring to FIG. 5, the inner panel 32 is shown vertically separated from the upper inner panel 20, permitting the shelf brackets 33 and 34 to be hooked over the upper edge of the panel 32 as shown at 35–38. These shelf brackets are useful for the storage of support equipment that may be associated with the computers and communication devices positioned on or near the top of the desk. Conduits from such support equipment may be led through appropriate holes in the floor 29, if desired. Alternatively, the floor 29 may be terminated short of the vertical beams 21 and 22, as shown in FIG. 3. Wires from electrical outlets on the floor below the desk, as indicated at 30*a*, in FIG. 3, may also be led up into the wall structure at these points. The interior space may be partitioned as shown at P in FIG. 3 to separate the various items. It should also be noted that the tops of the beams 21 and 22 are also terminated or recessed below the covers 26 to provide for the running continuity of space in the successive modules.

Figure 2:
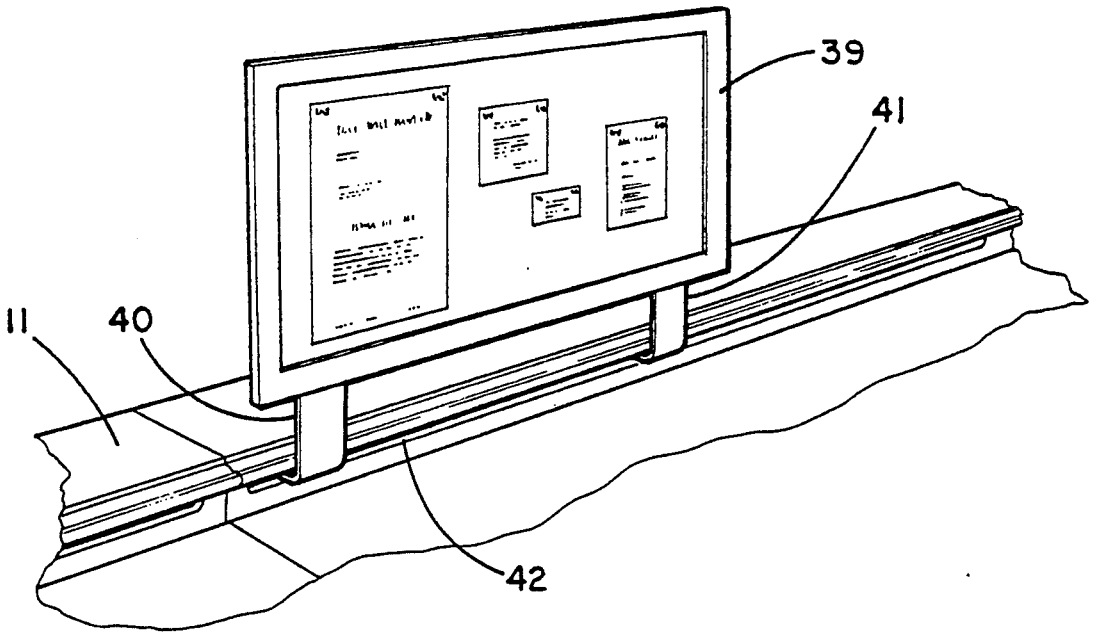
FIG. 2 is a fragmentary perspective view showing a tack board as an accessory installation in conjunction with the desk.
Figure 8:
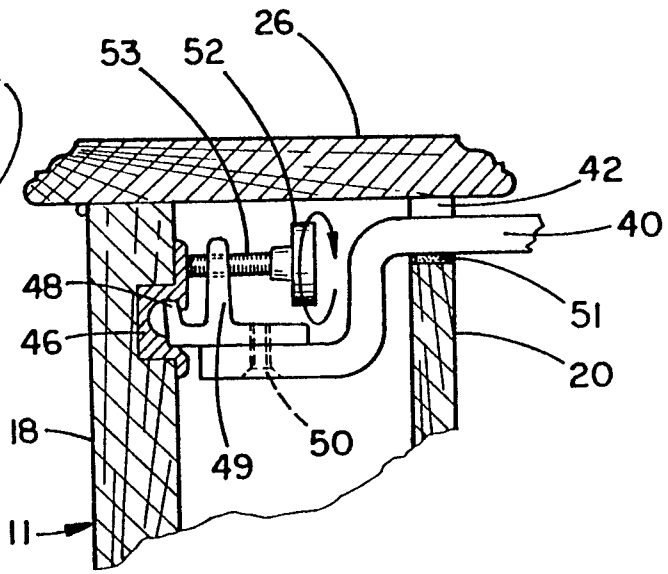
FIGS. 6, 7, and 8 show successive views in section, illustrating the installation and securing of a bracket for supporting a desk accessory.
Figure 7:
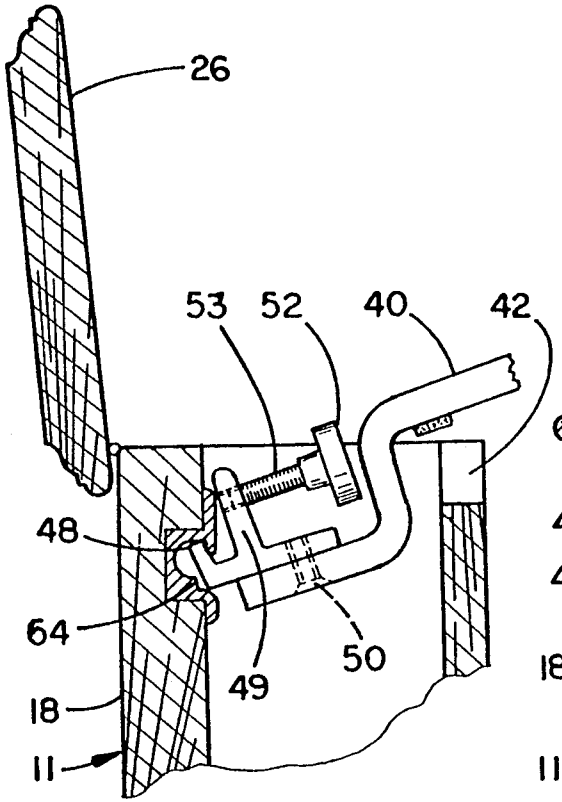
Figure 6:
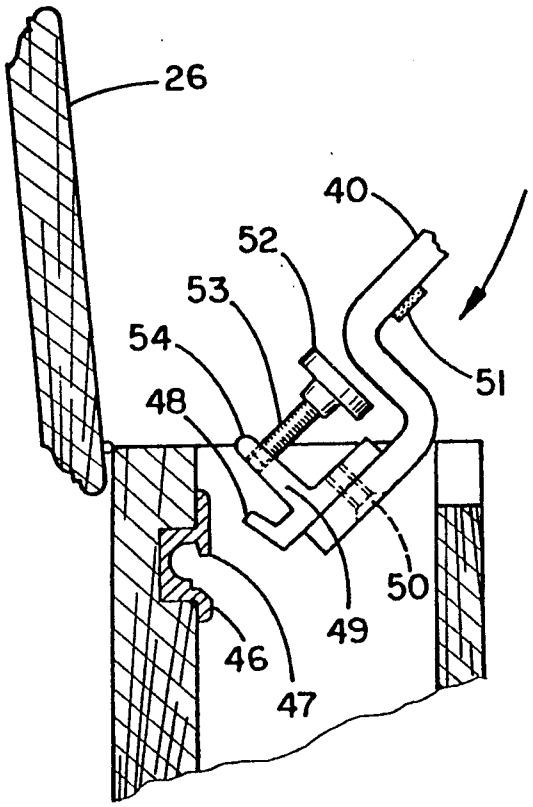

FIGS. 2 and 4 illustrate examples of accessory devices that can be mounted on the half-wall structure without interfering with the space on the desk top. In FIG. 2, a tack board 39 is supported by the brackets 40 and 41 traversing the slot 42 in the upper portion of the half-wall structure 11. In FIG. 4, the book shelf 43 is shown supported by the brackets 44 and 45 traversing the same slot. The terminal system shown in FIGS. 6, 7, and 8 extends along opposite the slot, and thus provides for a considerable degree of lateral adjustability of the accessories as may be required. The terminal member is an extrusion 46 having a hook portion 47 receiving the mating hook 48 of the coupling attachment 49 secured to the bracket 40 by screws as indicated at 50. The bracket arm 40 and its attachment 49 are first inserted into the space between the inner and outer wall panels, as shown in FIG. 6. Since the top of the slot 42 is defined by the cover 26 when the cover is closed, the opening of the cover opens the slot for the admission of the accessory bracket arm 40. After the hooks 47 and 48 are interengaged as shown in FIG. 7, the bracket arm is pivoted downwardly to bring the components into the FIG. 8 position. An abrasion reducing pad 51 can be adhesively (or otherwise) secured to the underside of the bracket arm 40 at a position at which it will rest upon the top edge of the inner panel 20 defining the lower extremity of the slot 42. Before closing the cover 26, a knob 52 controlling the bolt 53 is rotated so that it advances in its threaded engagement with the flange 54 of the attachment 49, and forms an abutment that can be tightened against the upper portion of the extrusion 46 to prevent an upward rotation of the assembly that might disengage the hooks forming the terminal connection. The final tightening of the knob 52 should take place after the lower part of the hook 48 interengages with the offset 64 of the extrusion 46 so that the position of the attachment is securely determined. The tightening action forces these portions of the components into solid engagement, and prevents both radial and tangential displacement of the coupling with respect to the hook of the terminal and prevents the bracket from sliding sideways in the slot.

Figure 10:
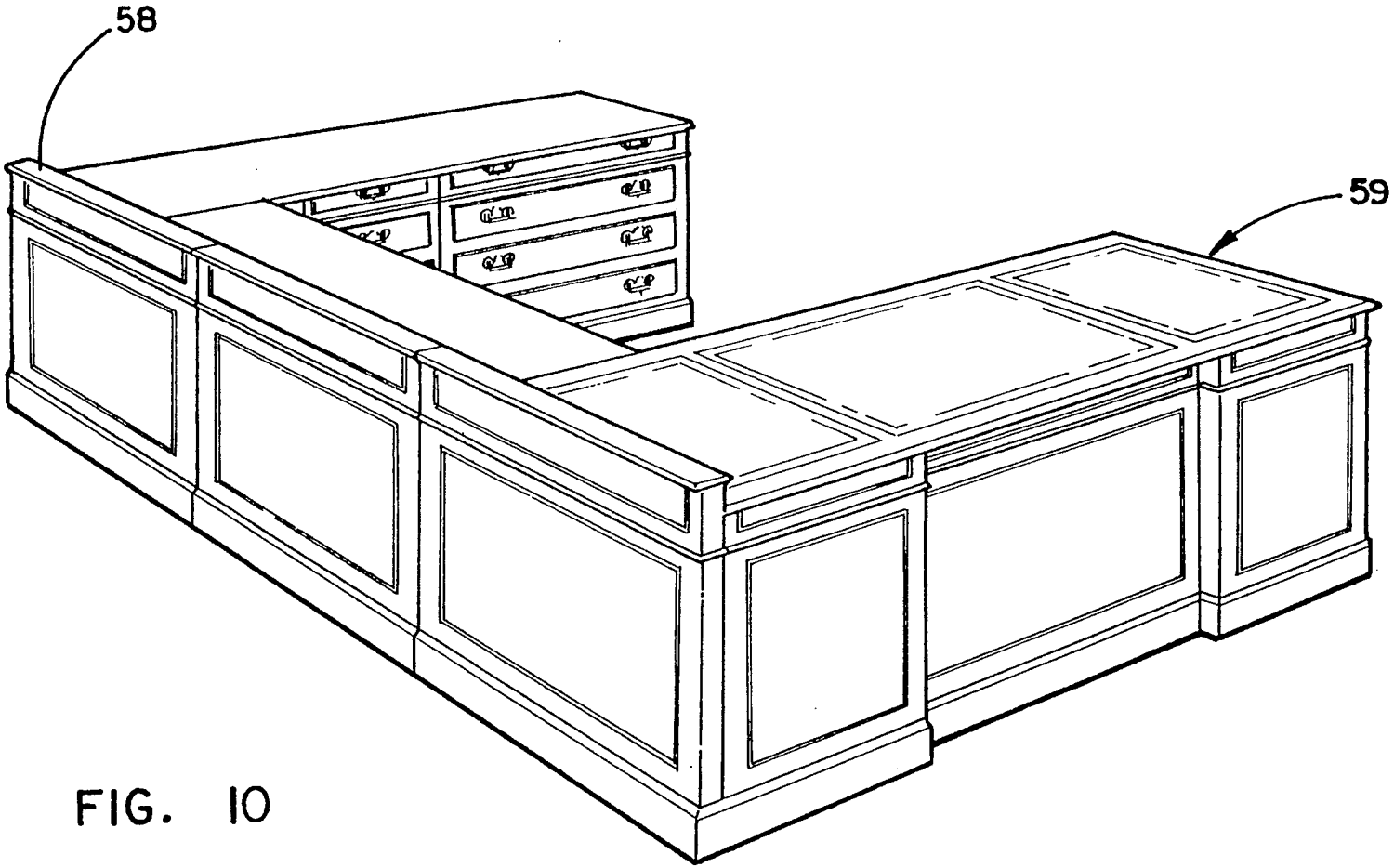
FIG. 10 shows a U-shaped desk, with the invention incorporated along the closed side.
Figure 9:
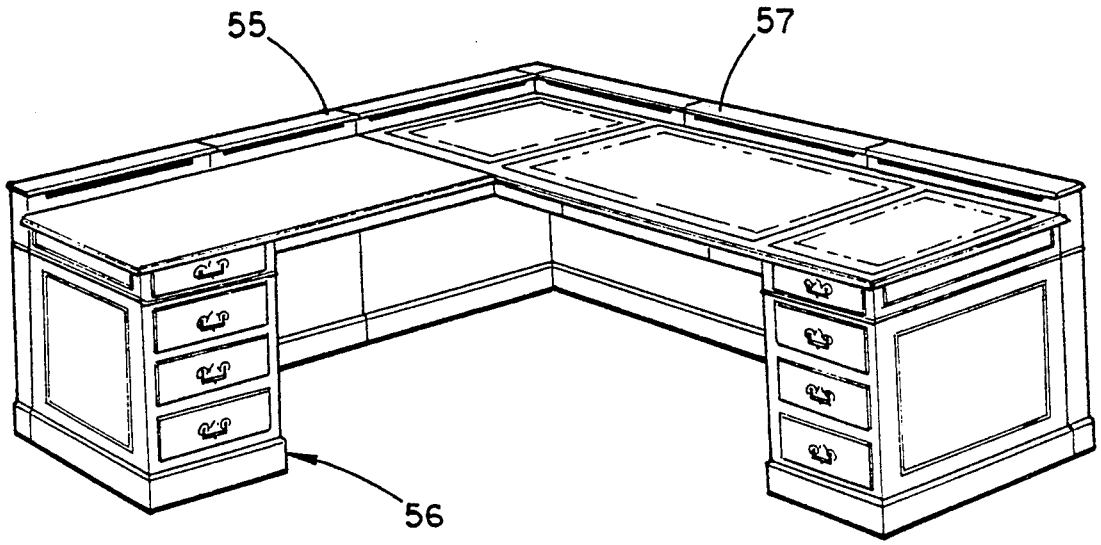
FIG. 9 shows the invention incorporated in an L-shaped desk, along both sides.
Figure 11:
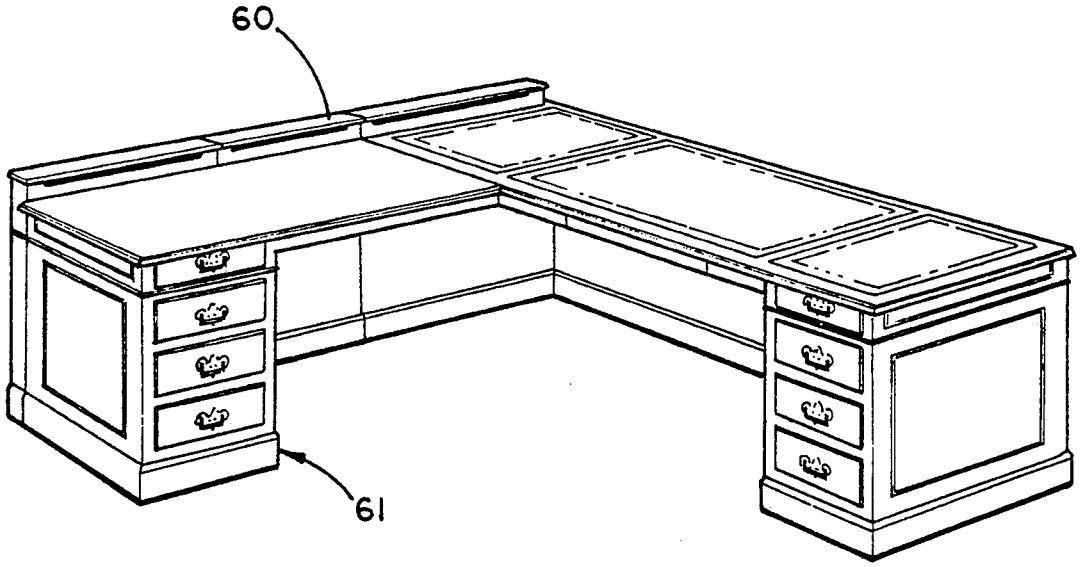
FIG. 11 shows an L-shaped desk, with the invention incorporated along one side only.

FIGS. 9, 10, 11 show the invention incorporated in various desk configurations. In FIG. 9, the wall structure 55 extends along one side of an L-shaped desk 56, and the wall structure 57 along the other side. In FIG. 10, the wall structure 58 extends along the closed side of the U-shaped desk 59. In FIG. 11, the wall structure 60 extends along one side of the L-shaped desk 61. These views illustrate the adaptability of the structure to the various common forms of executive desks.

Figure 21:
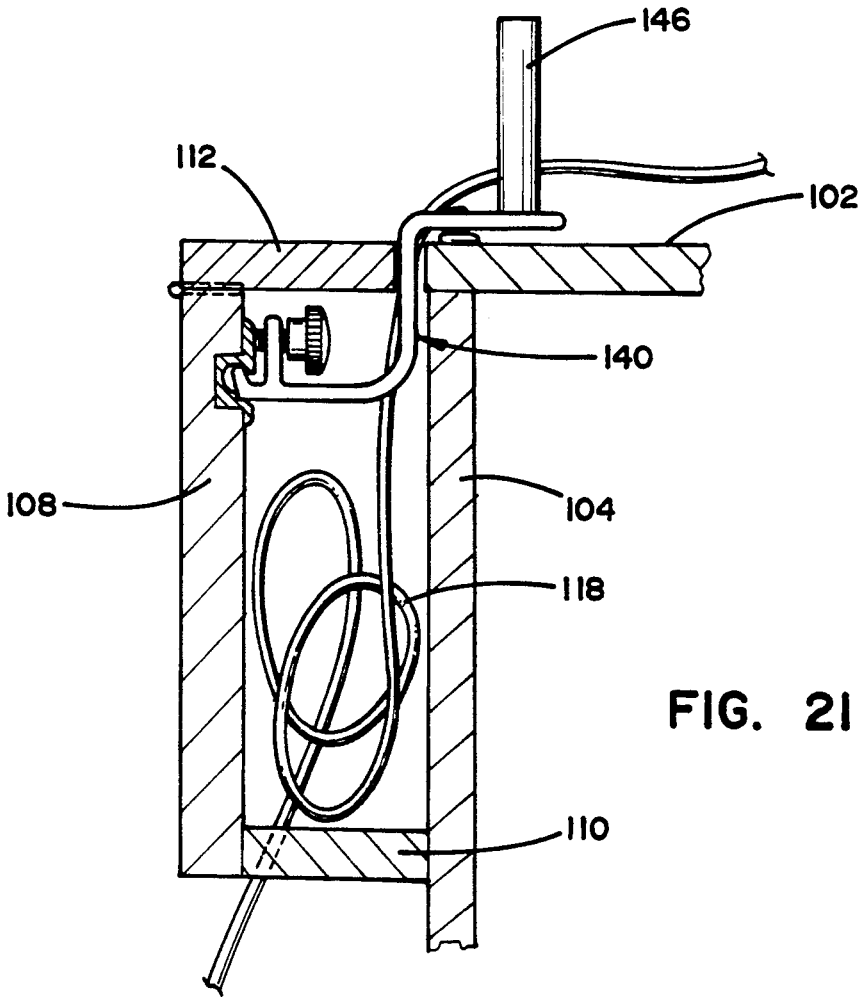
FIG. 21 is a cross-sectional view taken along line 21—21 of FIG. 20.

Another embodiment of the present invention, shown in FIGS. 12–24, comprises a desk 100 having a horizontal work surface 102 and a vertical panel 104 constituting the rear side (it could be any side) of the desk. The desk has sides 124 and a drawer 125. In this embodiment, rather than having a separate half-wall structure constituting the rear portion of the desk, a separate storage receptacle or tunnel 106 is formed at the upper rear edge of the desk. The storage receptacle is formed between an outer vertical panel 108 and inner or rear panel 104. A bottom 110 interconnects panel 108 with panel 104 at a lower point below the desk surface. Vertical panel 108 terminates at the top of panel 104, and a hinged cover 112 is attached by hinge 114 to the outer upper edge of panel 108. The width of cover 112 is less than the width of the open space between panels 108 and 104, such that when the cover is closed, a slot 116 is formed along the tunnel. As shown in FIG. 21, storage tunnel 106 serves to house wires and cables 118 for desk top accessories 120, which can be anything from calculators to computers to telephones or the like. Wires and cables 118 extend downwardly from the storage tunnel 106 to a receptacle outlet or other interconnection mounted in the floor or elsewhere. The wires extend through openings 122 at opposite ends of bottom panel 110, which terminates inside outer sides 124 of the desk, so as to leave the open spaces 122 adjacent the opposite ends of the bottom panel. Sides 124 extend outwardly to panel 108, leaving a recess 127 in the desk under the wire storage tunnel. Power or communication outlets, such as outlet 30 of the previous embodiment, can be housed in the storage receptacle.

Figure 15:
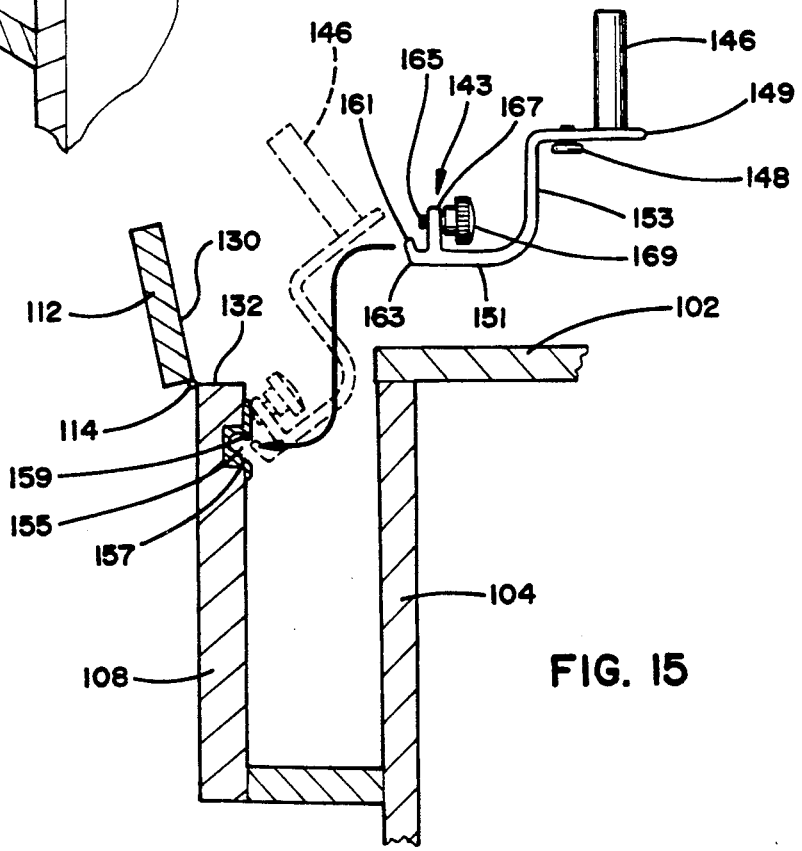
FIG. 15 is a sectional view showing a side elevation of the storage tunnel and the manner in which the mounting bracket is mounted in the tunnel.

As shown in FIG. 15, cover 112 is hinged to the rear edge of panel 108 by means of hinge 114. Engagement of the underside 130 of cover 112 with the upper side 132 of panel 108 holds the cover in a level position when it is closed.

Figure 13:
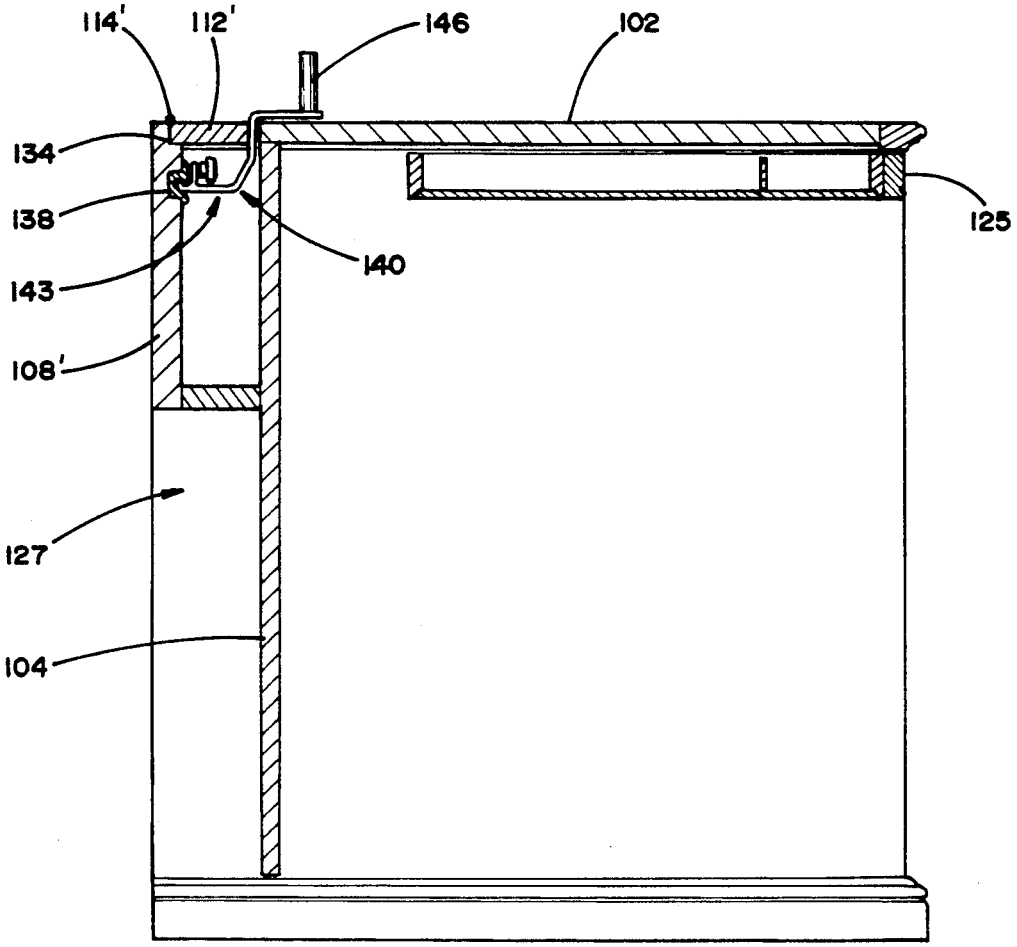
FIG. 13 is sectional side elevation view of the embodiment of FIG. 12.
Figure 20:
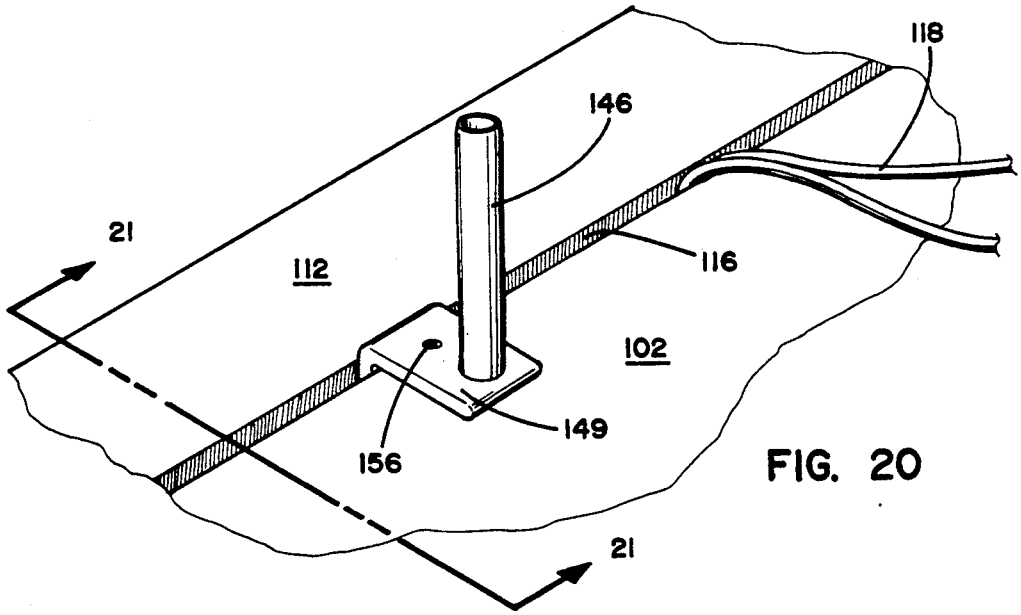
FIG. 20 is a perspective view of the embodiment of FIG. 12, showing the bracket mounted in the storage receptacle and the cover closed.
Figure 12:
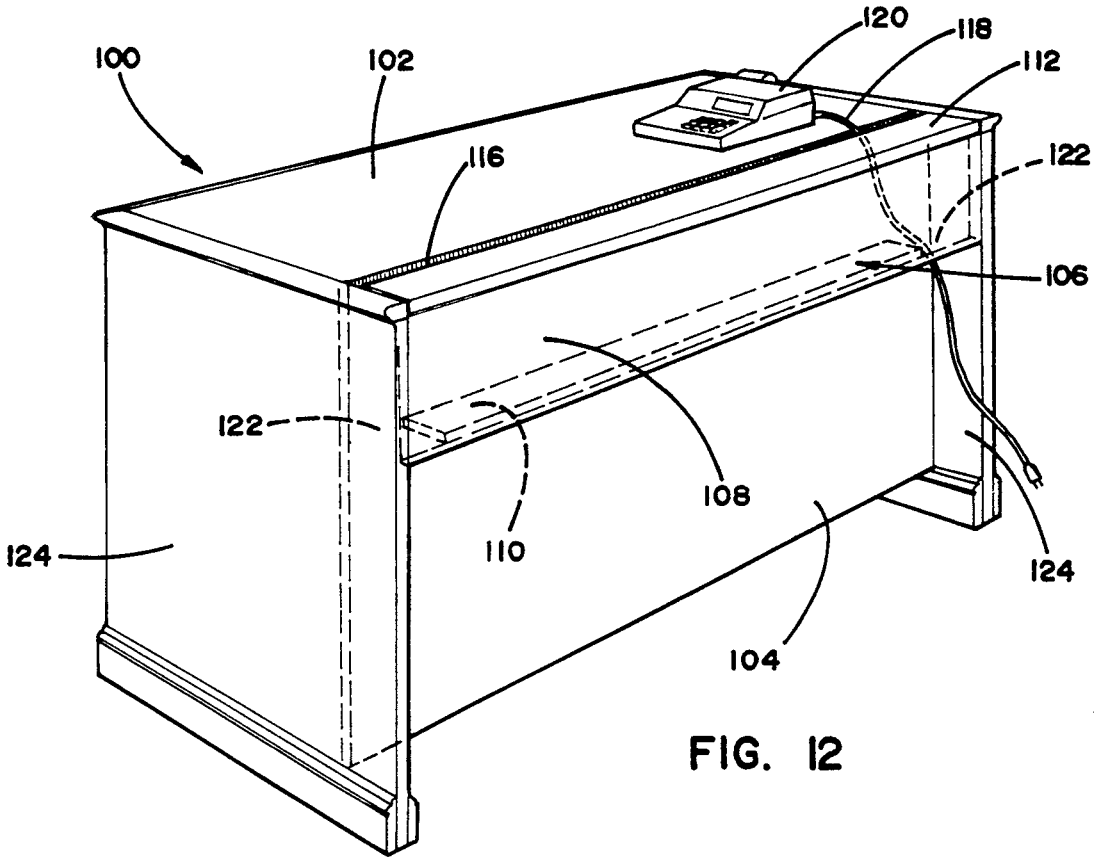
FIG. 12 is a perspective view of a second embodiment of the desk and storage unit of the present invention.
Figure 19:
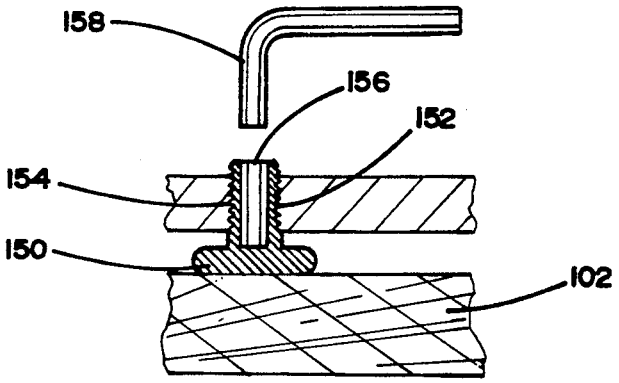
FIG. 19 is a sectional view of the support foot mechanism of the present invention.
Figure 14:
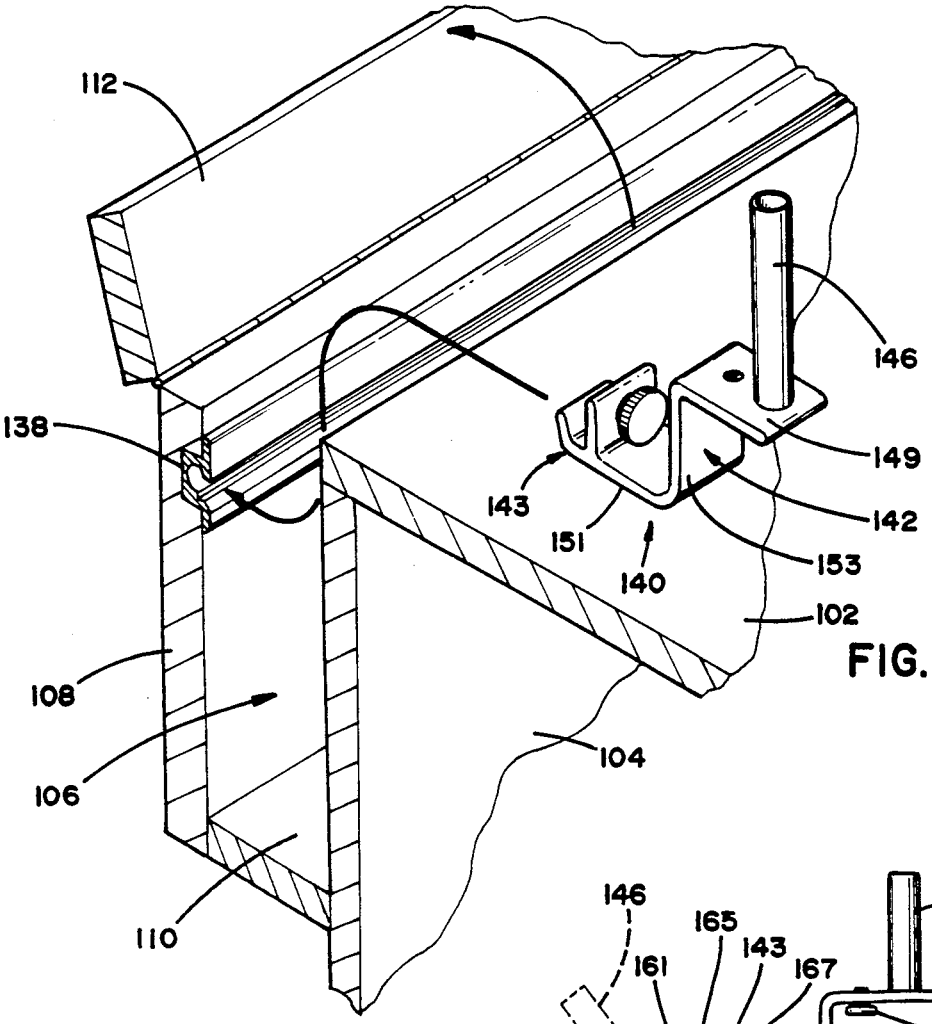
FIG. 14 is a fragmentary perspective view of the FIG. 12 embodiment of the present invention showing the manner in which the accessory bracket is mounted in a storage tunnel at the rear of the desk.

In an alternative construction shown in FIG. 13, panel 108' may be formed with a rectangular recess 134 along the upper inner edge of the panel, with cover 112' fitting in the recess and being hinged to the panel by a hinge 114' that connects the outer edge of cover 112' and panel 108' at the upper rear edge of the door.

In addition to conveying wiring, housing power and communication outlets and storing equipment, the storage tunnel houses a bracket assembly for mounting various desk accessories on the desk above the surface of the desk. The bracket assembly includes a terminal member in the form of a horizontal mounting strip or rail 138 of the type described above in connection with the first embodiment of the invention. A bracket assembly 140 is mounted in a longitudinally adjustable position on the mounting strip in the same manner also as described above for the previous embodiment. Bracket 140 comprises a generally Z-shaped bracket arm 142 having a coupling 143 at an interior end 147 and a tubular accessory support 146 extending upwardly from an exterior end 149 of the bracket arm. The interior portion of the Z-shaped arm includes a lower portion 151 extending inwardly from the coupling toward the front of the desk and an upwardly extending portion 153 extending upwardly through slot 116 to the upper surface of the desk. The exterior portion then extends inwardly over the desk surface to an end that supports the accessories.

The coupling 143 is the same as coupling 49 except that coupling 143 is integrally formed as part of the bracket instead of being attached to the bracket arm with screws.

In both cases, the terminal is a mounting strip extending along the desk parallel with and preferably coextensive with the slot. The mounting strip or rail 138 has a generally C-shaped recess 155 therein with a bottom support surface 157 and a downwardly extending hook portion 159 in the form of a longitudinal flange extending downwardly from the top of the recess. The flange or hook has downwardly and inwardly inclined cam surface on the interior side.

The coupling includes a mating upwardly extending hook portion 161 with an upwardly and outwardly inclined cam surface thereon that mates with the cam surface on the downwardly extending hook portion. The bottom surface of mounting strip includes a corner that engages a corresponding corner 163 on a bottom surface of the coupling. This corner provides vertical support for the coupling and bracket and assists in limiting downward pivotal movement of the bracket.

Screw 165 is threaded into a flange 167 on the opposite side of hook 159 from upwardly extending hook 161 and engages the mounting strip at a point above the engagement point of the two hooks. This urges the corners securely together by engagement of the cam surfaces and restrains release of the bracket by counterrotation of the bracket.

By loosening the knob 169 on the screw the bracket can be slid along the mounting strip or pivoted upwardly and removed from (or inserted on) the mounting strip at any point along its length. The access cover is conveniently raised to permit this pivotal movement.

The exterior portion of the bracket is supported on the desk surface (or on the edge of the slot) by means of a padded support foot 148, which is mounted on the underside of the exterior portion of the bracket so that it rests on the surface of the desk, preferably adjacent the edge of the slot. Support foot 148 has an abrasion resistant pad 150 mounted on the head of a threaded shaft 152 that screws in a threaded opening 154 in the bracket arm. The shaft has a upper end with an internal hex opening 156 that fits a hex or Allen wrench 158 for vertical adjustment purposes. The adjustable support foot can thus be raised and lowered in order to vary the level of the exterior portion of the bracket arm on the desk surface. This is an important feature of the present invention, as it permits the bracket to always be maintained at a level position on the desk surface, regardless of the weight of the load on the bracket.

Another important feature of the bracket is that it can be used with either embodiment of the desk or present invention (the half-wall structure of FIGS. 1–12 or the structure of FIGS. 13–24) without modification.

Figure 23:
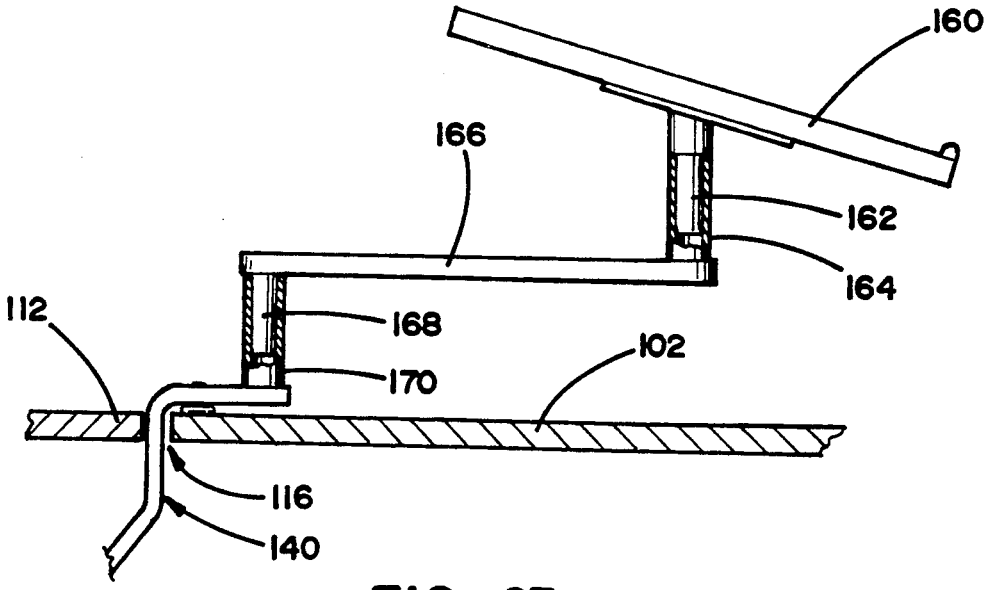
FIG. 23 is a side elevational view of the equipment stand of FIG. 22.
Figure 22:
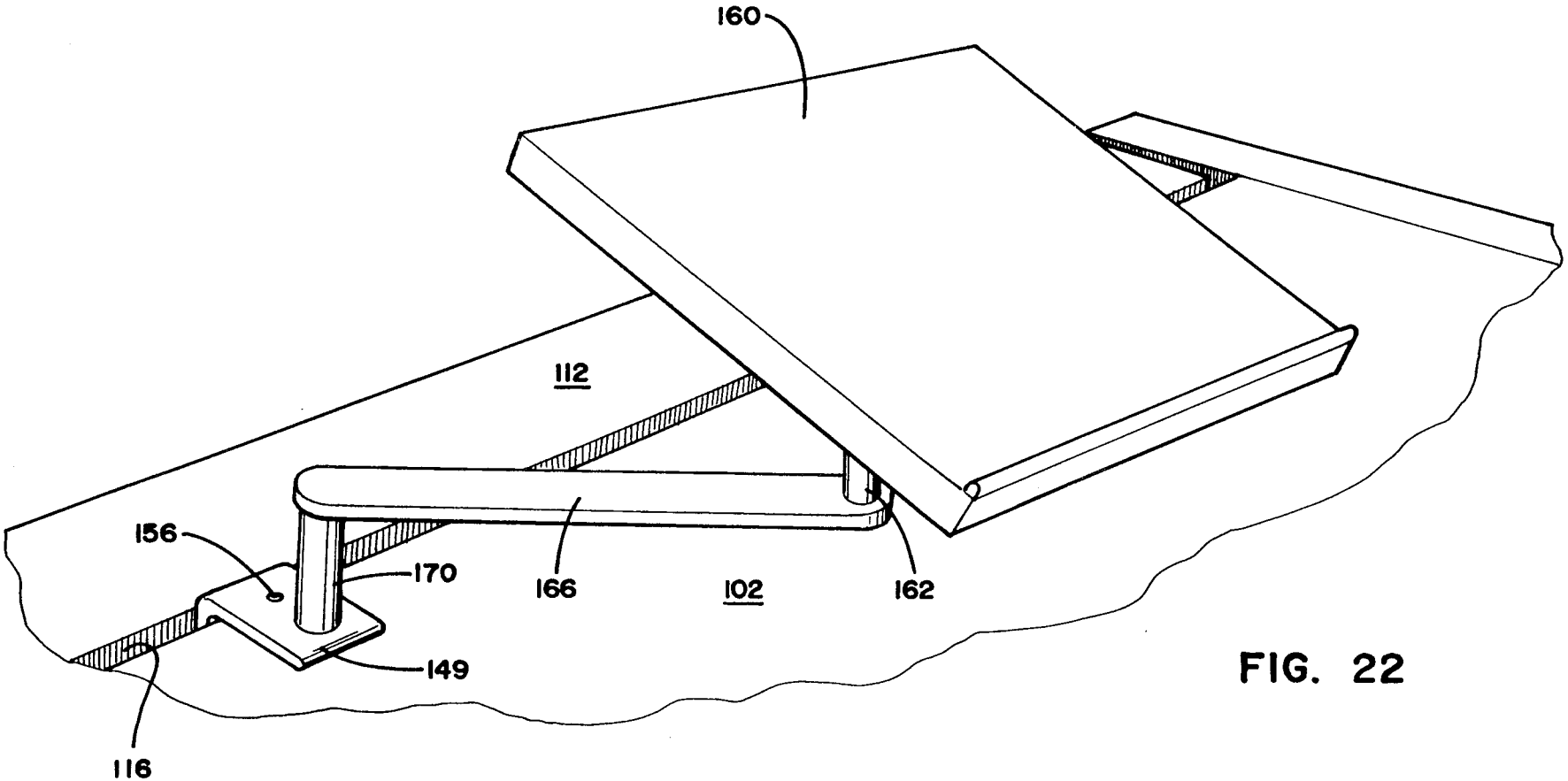
FIG. 22 is a perspective view showing an equipment stand mounted on the accessory bracket.
Figure 24:
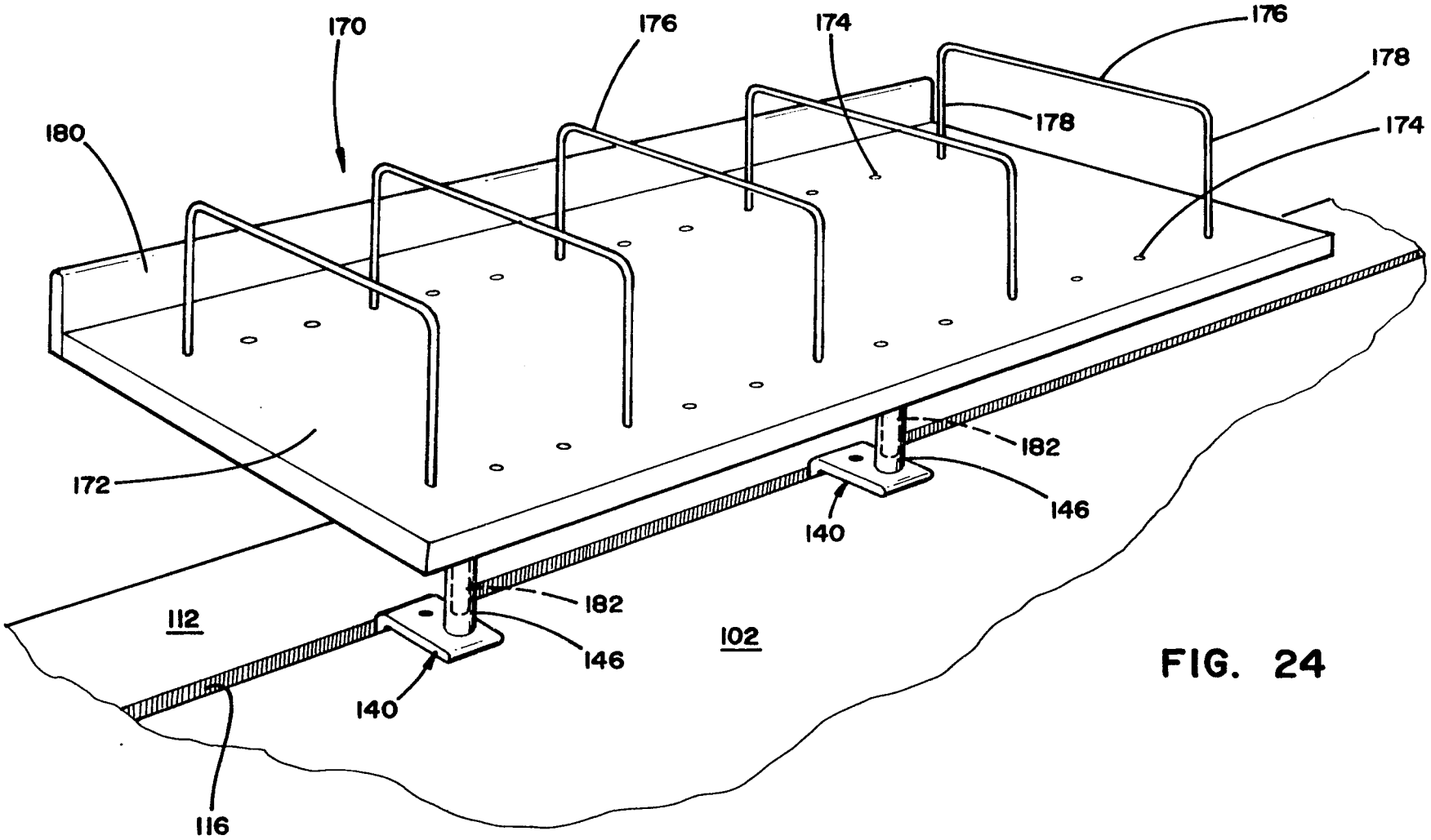
FIG. 24 is a perspective view showing a bookshelf unit mounted on a pair of support brackets.

Examples of types of desk accessories that may be mounted on the brackets of the present invention are shown in FIG. 22–24. In FIGS. 22 and 23, an inclined equipment platform 160 is mounted on a vertical shaft 162. Shaft 162 fits in a vertical tube 164 mounted on an arm 166 that has a vertical shaft 168 extending downwardly from the other end thereof. Shaft 168 fits into tube 170 on the outer end of the bracket arm. The positions of the tubes and shafts could be reversed. For example, the shaft could extend upwardly from the outer end of the bracket arm and a tube could cover the shaft. Alternatively, a larger tube could cover a smaller tube. The important feature is that the support is provided by telescoping or interfitting cylindrical surfaces that provide support over a relatively long axial distance and permit at the same time rotation of the supported element around the support member. Support arm 166 provides an advantage because it permits both ends of the arm to be pivoted in order to provide a wide variety of position adjustment for the work supporting surface. Other accessories could also be mounted in the support arm.

In FIG. 24, a bookshelf mechanism 170 comprises a flat base 172 having two rows of holes 174 spaced along opposite sides of the base. U-shaped rods 176 having downwardly extending legs 178 fit into any selected pair of opposed openings 174 in the base in order to provide variation of the width of the supports along the base. The supports act as bookends for books or other things that are stored on edge on the shelf. A raised edge 180 extends along the back edge of the base.

The base is supported on a pair of brackets 140 spaced apart along slot 116. The base can include a pair of downwardly extending shafts 182 that fit into tubes 146, or they could comprise larger tubes that fit over tubes 146. The support members in this case hold the bookshelf in a rigid level position, with the books being positioned above the work surface so that use of the work surface can be maximized. Other types of accessories also can be mounted on the support brackets.

The foregoing are illustrative of the preferred practice of the present invention.

The embodiments of the present invention in which an exclusive property or privilege is claimed are defined as follows:

1. An article of furniture having a top providing a work surface, wherein the improvement comprises:

horizontally spaced parallel inner and outer panels forming at least one side of said article of furniture, and providing a storage receptacle between said panels;

a cover movably secured to the furniture so as to form a top closure for said storage receptacle, a horizontal access slot to the storage receptacle being formed adjacent the cover;

accessory bracket means for supporting desk accessories above the surface of the desk, the accessory bracket means being mounted in the storage receptacle and extending through the slot to support the desk accessories; and terminal means for supporting the accessory bracket means by engagement with coupling means on the accessory bracket means, the terminal means being secured to the outer panel in the interior of the storage receptacle, the terminal means having a hook portion opening downwardly, and said coupling means having a mating hook portion engageable with said terminal hook portion in an upwardly rotated position of said coupling means hook portion, said coupling means also having an adjustable abutment extendable after engagement of said terminal and mating hook portions to prevent back-rotation of said bracket means toward a disengaging position.

2. An article of furniture as defined in claim 1, wherein the cover is pivotally mounted on the top of the outer panel, and one edge of said slot is defined by said cover in the closed position thereof.

3. An article of furniture as defined in claim 1, wherein said accessory bracket means is at least partially supported by the work surface or panel adjacent said slot.

4. An article of furniture as defined in claim 3, wherein said terminal means is a continuous member extending opposite the full length of said slot.

5. In a desk comprising a work surface, a wire storage receptacle having an open interior and including a pair of spaced side panels and a bottom, the wire storage receptacle being adjacent the work surface and accessible from the desk top through an access opening, the access opening being partially closable by a cover covering the opening, a longitudinal slot for wire egress and the like being formed between the cover and the desk and running along the wire storage receptacle, the improvement comprising accessory bracket means releasably mounted in the interior of the storage receptacle by bracket mounting means and extending therefrom outwardly through the longitudinal slot, the portion of the accessory bracket means extending out of the slot serving to support desk accessories off the surface of the desk, the bracket mounting means comprising a terminal mounting strip mounted in the interior of the wire storage receptacle and extending along the receptacle parallel to and in communication with the slot, a coupling means at an interior end of the bracket means serving to attach the bracket means to the terminal mounting strip, the coupling means permitting the bracket means to be moved to a variety of positions along the terminal mounting strip.

6. A desk according to claim 5, wherein the terminal mounting strip is attached to an inside surface of an outer side panel and runs longitudinally along the panel opposite the slot, the mounting strip having a contoured surface facing the slot that engages and mates with the coupling on an inner end of the bracket means, the bracket means being supported by engagement between the coupling and the mounting strip, the bracket means being movable along the mounting strip so as to be supportable at different positions along the slot.

7. A desk according to claim 6, wherein the mounting strip includes an inwardly and then downwardly extending flange that extends longitudinally along the mounting strip, and the coupling includes an outwardly and then upwardly extending hook that fits in the mounting strip behind the mounting strip flange, the flange holding the bracket means in position and restraining the bracket means from pivoting downwardly in the mounting strip when the bracket means is in a mounted position in the mounting strip.

8. A desk according to claim 7, wherein the hook fits behind the flange and is disengagable from the mounting strip when the coupling is pivoted upwardly, the hook engaging the flange when the coupling is pivoted downwardly to the point where the bracket means is in its mounted position, the flange restraining the bracket means against pivoting downwardly past its mounted position.

9. A desk according to claim 8, wherein a lower portion of the hook rests on an offset portion of the mounting strip when the bracket means is in its mounted position, the offset portion providing support against vertical and pivoted movement of the bracket means.

10. A desk according to claim 9, wherein the coupling comprises a locking screw rotatably mounted in the coupling so as to be extendible into contact with the mounting strip at a position such that the force of the locking screw holds the bracket in its mounted position, the screw being retractable to dismount the bracket means from the mounting strip.

11. A desk according to claim 5, wherein the accessory bracket means is at least partially supported by the work surface or edge of the slot in the inner panel.

12. A desk according to claim 11 wherein the accessory bracket means is separated from the lower edge of the slot by a wear resistant pad mounted on the accessory bracket means.

13. A desk according to claim 12, wherein the wear resistant pad is mounted on a support foot comprising a threaded shaft that is screwed through the bracket means, the shaft including a wrench fitting at an upper end thereof for vertical adjustment of the height of the bracket means.

14. In an article of furniture providing a work surface, an enclosed wire storage receptacle formed by spaced side panels adjacent the work surface, an access opening providing access into the interior of the storage receptacle from the desk top, and an openable top mounted on the storage receptacle so as to selectively close the access opening, a longitudinal slot for wires and the like being formed between the top and the storage receptacle, with the top forming a side of the slot when the top is closed; the improvement comprising:

an elongated bracket mounting terminal mounted on a side panel in the interior of the storage receptacle and extending along the storage receptacle parallel to and in communication with the slot, the terminal comprising an elongated mounting strip;

one or more accessory brackets having an interior end inside the storage bracket and extending through the slot to an exterior end that support work surface accessories; and coupling means at the interior end of the bracket for selectively mounting the bracket at a desired position on the mounting strip, the coupling means permitting the bracket to be moved longitudinally along the slot so as to position the accessory at a variety of positions along the slot.

15. An article of furniture according to claim 14, wherein the mounting strip and coupling means have interfitting components that permit the bracket to be removed from and mounted on the mounting strip at any point along the mounting strip and locked in one given position along the mounting strip.

16. An article of furniture according to claim 15, wherein the coupling means permits the bracket to be mounted on the mounting strip by opening the top and pivoting the bracket upwardly with respect to the mounting strip, the coupling means then being insertable into interfitting engagement with the mounting strip by pushing the coupling against the mounting strip, the bracket then being locked on the mounting strip by pivoting the bracket downwardly to an accessory supporting position, the bracket being removable from the mounting strip by pivoting the bracket upwardly and pulling the coupling out of interfitting engagement with the mounting strip.

17. An article of furniture according to claim 16, wherein the coupling means further comprises releasable clamp means for selectively preventing the bracket from being removed from the mounting strip by counter-rotation of the bracket, the clamp means further serving to restrain the bracket from sliding longitudinally along the mounting strip.

18. An article of furniture according to claim 17, wherein the mounting strip has a longitudinally extending generally C-shaped recess facing the interior of the storage receptacle, with the recess having a bottom surface and a downwardly extending hook portion positioned thereabove, the coupling having a bottom surface that rests on the bottom surface of the recess and having an upwardly extending hook portion that fits behind the hook portion of the mounting strip, the coupling hook portion being insertable into the recess and behind the downwardly extending hook portion when the bracket is pivoted upwardly, the upwardly extending hook portion fitting behind the downwardly extending hook portion when the bracket is pivoted downwardly with the components interfitting, engagement of the hooks preventing lateral removal of the coupling from the mounting strip and restraining the bracket from pivoting downwardly passed its accessory supporting position, the bottom surfaces engaging each other so as to limit inward lateral movement of the coupling into the recess, thereby further restraining downward pivotal movement of the bracket in the recess.

19. An article of furniture according to claim 18, wherein the upwardly and downwardly extending hook portions have mating inclined cam surfaces that urge the coupling downwardly against the bottom surface of the recess as a downward pivotal force is exerted on the bracket when it is mounted on the mounting strip.

20. An article of furniture according to claim 19, wherein the coupling means includes an upwardly extending flange positioned on the opposite side of the downwardly extending hook from the upwardly extending hook, the flange extending upwardly past the point where the two hooks engage, a laterally facing screw being threaded through the flange at a point above the points where the hooks engage and being extendable into contract with the mounting strip, the screw, when tightened against the mounting strip, urging the coupling into engagement with the mounting strip and resisting removal of the coupling by counter-rotation of the bracket.

21. An article of furniture according to claim 14, wherein the bracket includes an adjustable height support foot on the underside thereof that is positioned to engage the work surface or a panel to provide additional support for the bracket, the adjustment in height making it possible to vary the level of the bracket on the work surface.

22. An article of furniture according to claim 19, wherein accessories are mounted on the bracket by co-axially interfitting cylindrical members, one being mounted on the exterior end of the bracket and extending upwardly therefrom and the other being mounted on the accessory, the interfitting cylindrical members permitting rotation of the accessory on the bracket.

23. An article of furniture according to claim 22, wherein the cylindrical members comprise a sleeve mounted on the bracket and a cylindrical member on the accessory that fits in the sleeve.

24. An article of furniture according to claim 22, wherein the accessories comprise an equipment stand including an equipment platform mounted on an arm, one end of the arm being mounted on the bracket by the interfitting cylinders and the equipment platform being mounted on the other end of the arm by interfitting cylinders, one extending upwardly from the arm and the other extending downwardly from the equipment bracket.

25. An article of furniture according to claim 22, wherein the accessories comprise a book shelf including an elongated base that is mounted on two brackets spaced apart under the base, the base having a plurality of pairs of spaced openings positioned longitudinally along the upper surface of the book shelf, one or more generally U-shaped members having legs that fit into any of the pairs of openings serving as movable position book ends for the book shelf.

26. An article of furniture according to claim 21, wherein the support foot includes a threaded shaft that is threaded in a vertical opening in the bracket, the threaded shaft extending through the bracket and having a wrench fitting at an exposed upper end thereof such that the level of the bracket can be adjusted from the upper side of the bracket by rotating the support foot with a wrench.

27. In a wire storage receptacle for a desk having a work surface, the wire storage receptacle having an open interior and being adjacent the work surface and accessible from the desk top through an access opening, the access opening providing a longitudinal slot for wire egress and the like that runs along the wire storage receptacle, the improvement comprising accessory bracket means releasably mounted in the interior of the storage receptacle by bracket mounting means and extending therefrom outwardly through the longitudinal slot, the portion of the accessory bracket means extending out of the slot serving to support desk accessories off the surface of the desk, the bracket mounting means comprising a terminal mounting strip mounted in the interior of the wire storage receptacle and extending along the receptacle parallel to and in communication with the slot, a coupling means at an interior end of the bracket means serving to attach the bracket means to the terminal mounting strip, the coupling means permitting the bracket means to be moved to a variety of positions along the terminal mounting strip.

28. A wire storage compartment for a desk according to claim 27 and further comprising releasable locking means for locking the bracket in position on the terminal mounting strip.

29. A wire storage compartment for a desk according to claim 27 and further comprising adjustment means for adjusting the position of the bracket with respect to the work surface of the desk.

* * * * *